United States Patent [19]

Harju

[11] 4,165,563

[45] Aug. 28, 1979

[54] AUTOMATIC PILOT APPARATUS FOR A PRINTER

[75] Inventor: Bert I. Harju, Södertälje, Sweden

[73] Assignee: Södertälje Tekniska Idé Produkter Aktiebolag, Södertälje, Sweden

[21] Appl. No.: 794,118

[22] Filed: May 5, 1977

[30] Foreign Application Priority Data

May 7, 1976 [SE] Sweden ..... 7605239

[51] Int. Cl.[2] ..... B43L 13/00

[52] U.S. Cl. ..... 33/18 R; 33/23 H

[58] Field of Search ..... 33/18 R, 18 B, 1 M, 33/23 R, 23 H, 25 R, 25 D, 23 K, 23 C, 25 E, 27 M, 27 J, 27 K, 27 L

[56] References Cited

U.S. PATENT DOCUMENTS

| | | | |
|---|---|---|---|
| 1,441,469 | 1/1923 | Wilkins | 33/18 B |
| 2,300,698 | 11/1942 | Pentz | 33/18 B |
| 3,324,762 | 6/1967 | Walter et al. | 33/18 B |

*Primary Examiner*—Charles E. Phillips

*Attorney, Agent, or Firm*—Larson, Taylor and Hinds

[57] ABSTRACT

Pilot apparatus for a printer includes a program mill which can be set for printing of a character such as the numeral "3". A guide unit, to which a printing element is connected, is actuated by the program mill by way of motors or the like which are able to move the guide unit in either of two directions in two paths perpendicular to one another. The program mill includes means for actuating the motors, either individually or concurrently, to move the guide unit along the two guide paths. The actuating means include a number of cam discs mounted on a common shaft, each cam disc being programmed for a particular character to be printed. The guide unit and printing element are interconnected by a linkage system. The guide unit may include two moveable plates each including a slot. The slots cross and provide a guide point at their intersection for transferring a printing movement from the guide plates to the printing element.

16 Claims, 8 Drawing Figures

AUTOMATIC PILOT APPARATUS FOR A PRINTER

The present invention relates to a pilot apparatus for a printer, and more particularly the invention is directed to an automatic pilot apparatus by which the printer is given a complex movement corresponding to one or more preset characters.

By printer in this connection is meant any kind of printing means like a pencil, a drawing pin, a cutting, vibrating, burning or other reproducing tool.

The invention resulted as a solution to the problem of automatically providing a marking on just manufactured machine parts etc. For different reasons it is wanted to mark just manufactured machine parts, and generally this is done by punching a manufacturing number or the like on the machine part by means of special punching tools. This is time consuming work and there is always a risk that figures, letters or the like are reversed at the punching by means of the different punching tools.

Therefore there has been a need for an apparatus by which it is possible to automatically and without any special work provide a marking of objects in direct connection with the manufacture thereof and in which there is a guarantee that the marking is made with the same characters and character combinations according to a special preset schedule.

According to the invention the said problem is solved by providing a pilot apparatus for a printer, which apparatus automatically reproduces one or more preset characters and which comprises a program mill and a pilot unit connected thereto which at its output end carries a printing tool, and in which the program mill, depending on a preset character to be printed, alternatively activates a means for providing an actuation movement for the pilot unit in one direction or the other of a first direction or a means for providing an actuation movement for the pilot unit in one direction or the other of a direction which is opposite to the first mentioned direction, whereby a link system transmits a successive series of the two movements to the printing tool which according to the said series of movements reproduces the character which is impulsed by the program mill.

In the following the invention will be described more in detail with reference to the accompanying drawings. In the drawings FIG. 1 diagrammatically shows an automatic pilot apparatus according to the invention;

Figure 1:
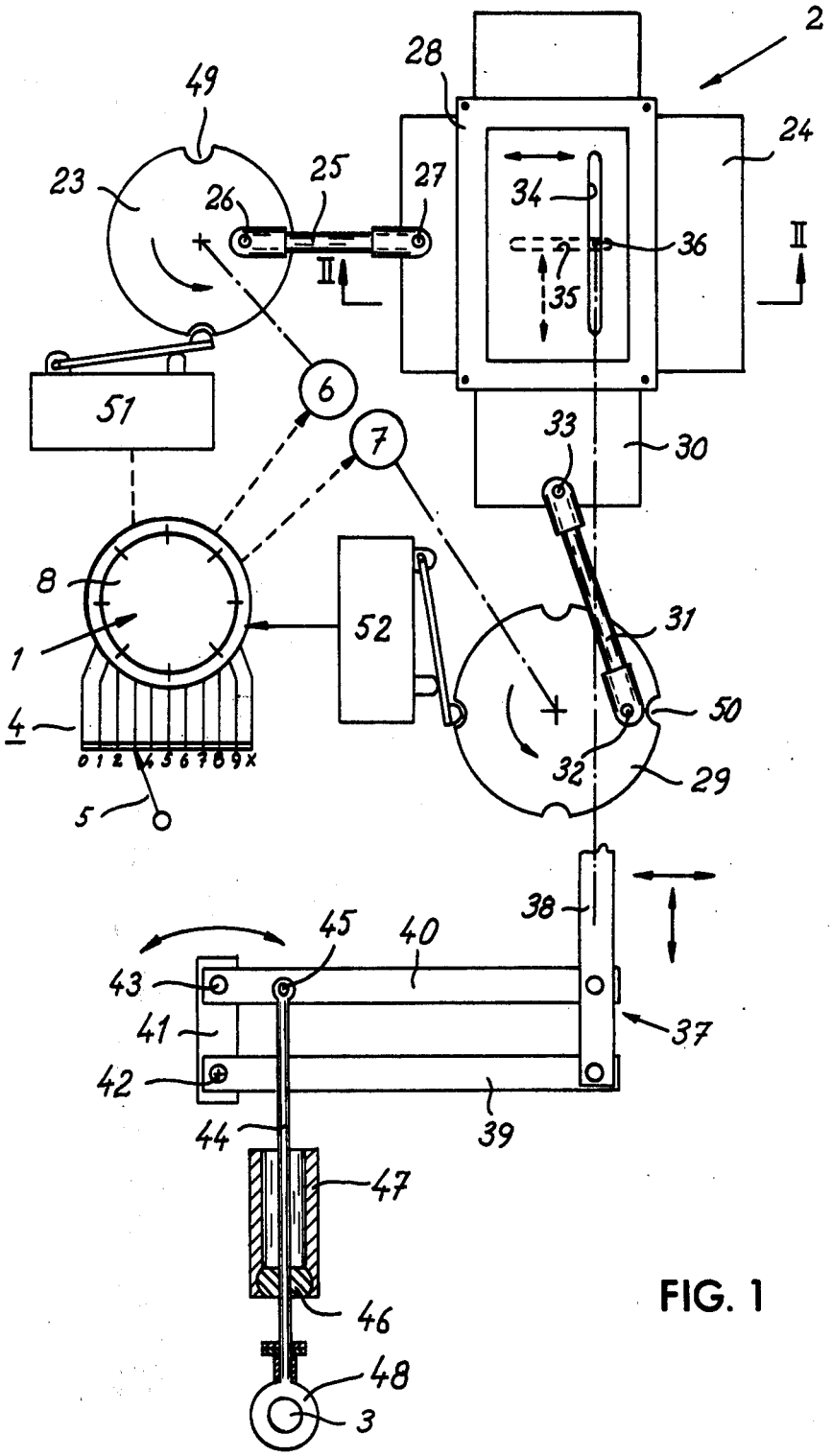

It is to be understood that the following specification and the embodiments of the invention shown in the drawings are only of illustrating character and that all kinds of modifications may be presented within the scope of appended claims.

The automatic printer pilot apparatus according to the invention comprises a program mill 1 which is connected to a pilot unit 2 which at the output end thereof carries a printing means 3 intended to reproduce one or more characters which are set on the program mill. The program mill includes a means for setting the characters to be printed, a means for alternatively providing a horizontal pilot movement or a vertical pilot movement and means for inducing a change of such pilot movements, means for providing a change for the reproduction of the next character after one character is reproduced and means for disconnecting the apparatus after all preset characters have been reproduced.

The means for setting the characters to be reproduced can be of any suitable kind, for instance a current distribution means having as many terminals as the number of alternative characters to be reproduced. For the sake of simplicity the apparatus will be described in the following only with reference to reproduction of figures between 0 and 9 and the current distribution means has a set pointer 5 which in this case is set for reproduction of the figure 3.

The means for alternatively providing a horizontal and vertical pilot movement includes two electric motors 6 and 7 respectively.

Figure 4:
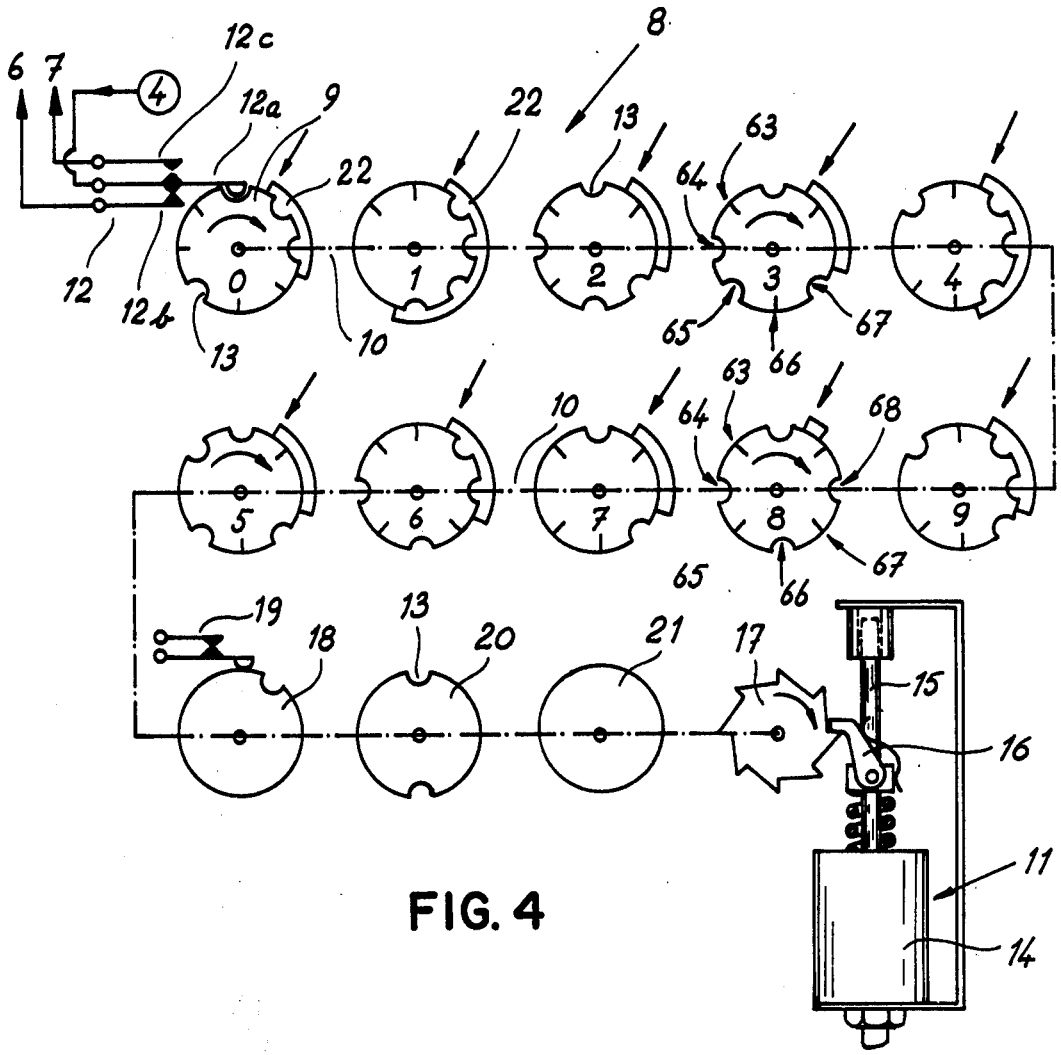
FIG. 4 shows diagrammatically a program mill of the apparatus according to the invention.

The alternative current supply to the said motors 6 and 7 is provided by a special cam means 8 having eight different positions. The cam means which in one embodiment is shown in FIG. 4 has a number of cam discs 9 which are mounted on a common shaft 10, and the means for inducing a change of pilot movement comprises a program mill motor 11 which successively or stepwise actuates the shaft 10. For each character to be reproduced there is one cam disc and each cam disc actuates a triple-pole circuit breaker 12. The center pole **12*a* of the breaker supplies current and is actuated by the cam disc, and one of the outer poles 12*b* is connected to the horizontal drive motor 6 and the second outer pole 12*c* is connected to the vertical drive motor 7**.

Each cam disc has several cams the total number of which corresponds to a special character. The cam discs are basically circular and in order to provide the 8-stage movement mentioned above they have eight different cam positions and cam shapes. The cam positions are evenly distributed along the periphery of the cam and they are formed both by the circular outer surface by the cam and of axial grooves 13 in the outer surface of the cam disc. The center poles **12*a* of the triple-pole breakers 12 engage the outer periphery of the cam discs and depending on the position of the cam disc, they can take either of two positions, one by engaging the grooves 13, whereby the horizontal drive motor 6 is actuated and the other by engaging the circular outer surface, whereby the vertical drive motor 7 is actuated. The formation of the cam discs with the circular outer surface and the grooves 13** respectively will be explained further in the following.

The program mill motor 11 is, in this embodiment shown as a solenoid 14 having a moveable shaft 15 on which a spring biassed pawl is fixedly mounted which pawl 16 engages a catch wheel 17 having eight cogs. Each time the solenoid 14 is actuated the shaft 10 is moved one eighth of a turn.

On the shaft 10 which is common for the figure cam discs 9, a further cam disc 18 for a breaker 19 is mounted, the purpose of which is to initiate an actuation of the program mill motor during the eight steps forming a complete working cycle. The cam disc 18 has only one groove corresponding to a disconnected position and it consequently takes a current supply position as soon as the moveable contact of the breaker 19 is moved out of the said groove.

On the shaft 10 a further cam disc 20 is mounted, the purpose of which is to provide a change of character after a working cycle for reproduction of a first character is completed and to initiate the apparatus for a following cycle for the reproduction of a successive character. For this purpose the cam disc 20 is preferably geared down, and in the illustrated example it is assumed that the cam disc 20 is geared down to half number of revolutions as compared with the shaft 10 and it is formed with two grooves 13 to provide a reproduction of two successive characters before the program mill finally disconnects itself. On the common shaft 10 a further cam disc 21 can be mounted, the purpose of which is to disactuate the printer 3 during some periods, e.g. by raising the printer from the workpiece or to disconnect the current to the printer in case the printer is an electric engraving pin or the like.

In this connection it can be observed that the cam discs 9 can be formed with a larger or a less number of cam functions than the above-mentioned eight functions depending on what function is wanted from the pilot unit 2, and when reproducing, for instance, letters it can be suitable to form the cam disc with a larger number of cam functions as will be further explained in the following.

On each figure cam disc 9 there is a projecting cam 22 which is of varying length for different figure cam discs. The purpose of cams 22 is to disactuate the writer 3 during functions of each particular cam disc where no writing movement is to be performed.

The horizontal drive motor 6 is drivingly connected to a cam disc 23 which in turn drives a horizontal guide plate 24 by a link 25. One end of the link 25 is rotatably mounted in the cam disc 23 by a pin 26 which is located on a distance from the center of the cam disc corresponding to half the intended horizontal movement of the pilot unit. The opposite end of the link 25 is rotatably mounted in the horizontal guide plate 24 by a pin 27. The horizontal guide plate is horizontally guided in a guide 28 which is fixed mounted in the support of the apparatus.

The vertical drive motor 7 drives a cam disc 29 which in turn drives a vertical guide plate 30 over a link 31 one end of which is rotatably mounted in the cam disc 29 by means of a pin 32 located a distance from the center of the cam disc 29 corresponding to half the intended vertical movement. The opposite end of the link 31 is rotatably mounted in the vertical guide plate 30 by a pin 33.

The horizontal guide plate 24 is formed with a slot 34 which extends in a direction perpendicular to the moving direction of the horizontal guide plate and which has a length at least corresponding to the vertical movement provided by the cam disc 29. The vertical guide plate 30 is in turn formed with a slot 35 which extends perpendicularly to the moving direction of the said plate and which has a length at least corresponding to the horizontal movement provided by the cam disc 23. The slots 34 and 35 are of equal width and they are located so as to overlap each other in all positions, whereby the cross point 36 between the two slots forms a square hole for a guiding pin belonging to a link system 37 for transmitting of the horizontal and vertical movements to the printer 3.

The said link system 37 includes by a guide link 38 which at one end is formed with a pin for co-action with the cross point hole 36 of the guide plates 24 and 30 and which at the opposite end is connected to a parallelogram link system comprising two parallel links 39 and 40 pivotally extending angularly from the guide link 38 and a connection link 41 for the opposite ends of the said parallel links. At the end of the outer parallel link 39, the connection link 41 is mounted in the support of the apparatus by means of a pivot pin 42, whereas the opposite end of the connection link 41 is rotatably connected to the inner parallel link 40 by means of a pin 43 so that this end of the parallel link and the pivot pin is freely rotatable. At a point between the pin 43 and the guide link 38 a printer arm 44 is rotatably mounted on a pin 45, and the said printer arm extends through a ball joint 46 in the support 47 of the apparatus and, at the outer end, the printer arm carries a holder 48 for the printer 3 which can, for instance, be an electric engraving tool. The link system 37 consequently has three guiding points, viz. the cross point hole 36 between the horizontal and the vertical guide plates 24 and 30, the pivot pin 42 of the support and the ball joint 46 of the support. It will be appreciated that a movement of the horizontal guide plate 24 provides a displacement in the horizontal direction of the guide link 38 in that the pin thereof is actuated by the slot 34, which provides a corresponding but oppositely directed movement of the printer 3. Likewise a movement of the vertical guide plate 30 provides a corresponding displacement in the vertical direction of the guide pin of the guide link 38 and a corresponding movement of the printer tool. A common movement of the guide plate 24 and the vertical guide plate 30 provides a diagonal movement of the guide pin of the guide link 38 and a corresponding diagonal movement of the printer tool. By alternative actuation of the drive motor 6, the vertical drive motor 7 or both at the same time it is thereby possible to provide a horizontal, a vertical or a diagonal printer movement respectively. By further varying the speed of the motors 6 and 7 it is possible to provide bow formed or circular movements as wanted.

The horizontal drive motor 6 and the vertical drive motor 7 are piloted directly by the program mill depending on the position of the center pole **12*a* of the breaker 12 so that only the horizontal drive motor 6 is actuated when the said center pole 12*a* is located in a groove 13 of the cam disc, whereas only the vertical drive motor 7 is actuated when the center pole 12*a*** is located on the circular outer periphery of the cam disc.

In order to provide a change of position of the cam discs 9 by moving the cam, the cam discs 23 and 29 are formed with cam grooves 49 and 50 respectively each co-operating with a breaker 51 and 52 respectively which are both connected to the program mill motor 11.

Depending on what movement steps are wanted in the pilot unit the cam discs 23 and 29 are formed with an optional number of cam grooves 49, 50, but in the illustrative example, the apparatus is formed for a movement in one step right and left respectively of the horizontal guide plate 24 and a movement in two steps upwards and downwards respectively of the vertical guide plate 30. For this purpose the horizontal cam disc 23 is formed with two cam grooves 49 provided diametrically opposed whereas the vertical guide plate is formed with four cam grooves 50 located at 90° angle in relation to each other.

Figure 3:
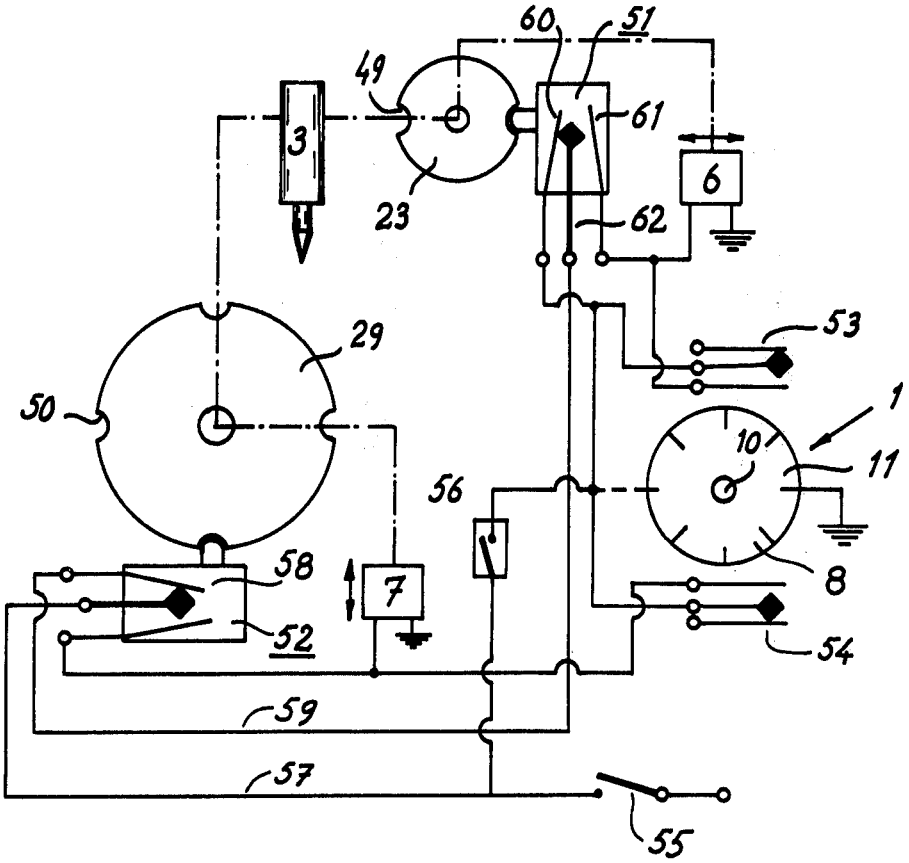
FIG. 3 shows diagrammatically a circuit diagram for providing the movements of the printer.

As evident from FIG. 3, the breakers 51 and 52 are connected in series and they are connected to the program mill motor 11 over by two breakers 53, 54.

For the connection of current, the pilot apparatus has a main circuit breaker 55 and for starting an operation cycle there is a momentary circuit breaker 56.

Figure 5:
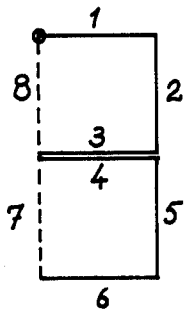
FIGS. 5 and 6 are illustrative examples of the method to reproduce the FIG. 3 and the FIG. 8 respectively.

The operation of the apparatus is as follows: The main circuit breaker 55 is switched on whereby current is supplied to the main conduit 57, through the center terminal of the breaker 52, over the inner terminal 58 thereof and through the conduit 59 to the center terminal 51 and over the inner terminal 60 thereof both to the program mill 1 and to the center terminals of the breakers 53 and 54. The current to the motors 6 and 7 is, however, disconnected since there has not been any action of the cam disc 18 and its breaker 19 which forms a break for a working cycle. By actuating the momentary circuit breaker 56, the system is, however, short-circuted and the program mill motor 11 is actuated so as to move on one step. Thereby the situation enters arises which is illustrated in FIG. 4 in which the breaker 19 supplies current to the current distribution unit 4. Depending on the setting of the pointer 5 current is only supplied to one of the figure breakers and for the explanation of the invention it is assumed that current is supplied to the breaker for the cam disc "3". When the program mill motor 11 moves on one step, the center terminal of the cam disc 3 falls into the groove 13 and current is supplied to the horizontal drive motor 6 over the conduits 57 and 59, through the center terminal of the breaker 51 which, by the rotation of the cam disc 23, is moved over to contact the outer terminal 61, over the said outer terminal 61 and the conduit 62. When the cam disc 23 is rotated, the horizontal guide plate 24 is moved in one direction or the other depending on the position of the cam disc 23 when the apparatus was switched on, but it is assumed that the disc was in the left hand position as shown in FIG. 1 when the apparatus was switched on. Thereby the disc 24 is moved to the right by a movement which in FIG. 5 is represented by "1". At the same time as the horizontal drive motor 6 began to rotate, the printer also started, and during the movement "1" this has printed a horizontal line.

When the cam disc 23 has rotated 180°, the center terminal of the breaker 51 falls into the corresponding groove 49 and the current to the horizontal drive motor 6 is disconnected at the same time as current is supplied to the program mill motor 11 by the breaker 53. The program mill motor now moves on to the next stage corresponding to point 63 of the cam disc, and in this position the center terminal 12*a* engages the cylindrical outer periphery of the cam disc and current is supplied to the terminal 12*c*, to the vertical drive motor 7, and the vertical drive motor 7 actuates the cam disc 29 to rotate, in this case 90°, until the center terminal of the breaker 52 drops into the next groove 50. This second movement which in FIG. 5 is represented by "2" follows in direct connection to the movement "1", and the printer 3 has performed a second printer movement corresponding to movement "2" of FIG. 5. When the center terminal of the breaker 52 now drops into the groove 50, the program mill motor 11 is once again actuated to move on to position 64 whereby the horizontal drive motor is once again actuated, but since the cam disc 23 at its first stage moved the horizontal guide plate 24 to its right hand position it now provides a movement to the left which is represented by the line "3" in FIG. 5.

The program mill motor now moves on to position 65, in which a new horizontal movement is performed, in this case in the right hand direction and this means that the previously printed line "3" is doubled by the movement "4" which for clearness is shown with separate lines in FIG. 5, but which of course follows with coinciding lines. After moving on to position 66, the vertical drive motor is once again actuated whereby the cam disc 29 is rotated further 90° and a line downwards "5" is drawn by the printer which line is a continuation of the previously drawn line "2". In position 67 follows a horizontal printing movement to the left corresponding to line "6" and now the FIG. 3 has been printed. The program mill which has eight positions has not yet returned to its initial position and to provide this "a blind movement" corresponding to lines "7" and "8" has to be made. This blind movement is provided by having the centre terminal of the breaker 12 engage the circular outer periphery of the cam disc and at the same time provide a disconnection of the printer by means of the projecting cam 22 either by raising the printer from the surface to be printed or by disconnecting the current to the electric motor for the printer. During the last steps consequently two movements are thus performed by the actuation of the vertical cam disc 29.

Figure 8:
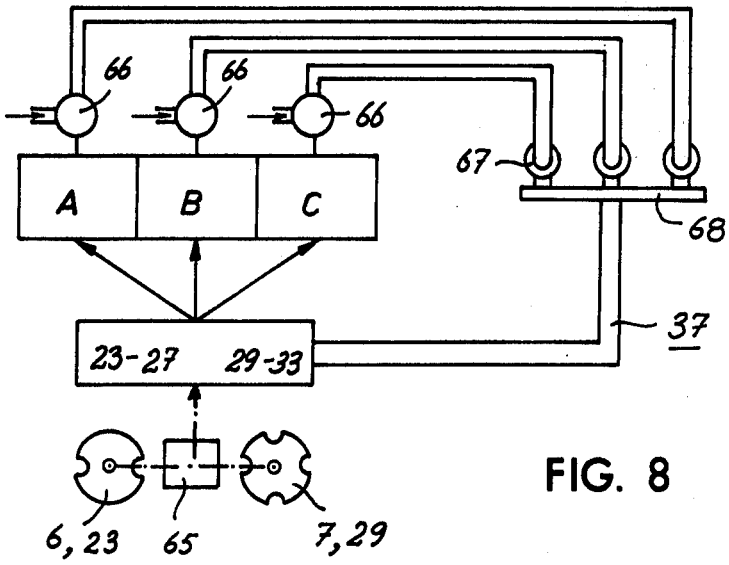
FIG. 8 is a block sketch of an apparatus according to the invention for printing three like or different characters at the same time.

A working cycle is now completed and if only one character is to be printed the pilot apparatus could be disconnected. It is however assumed that two characters are to be printed, and since the cam disc 20 which is geared down has now only rotated half a turn, a breaker for the said cam disc will drop into the second one of the two grooves 13 thereof to initiate the start of a successive working cycle. This can be done in that the breaker of the character change disc short-circuits the breaker 19 of the switch on cam disc 18 or by actuating a relay which both short-circuits the breakers 51 and 52 as mentioned above and provides a connection of the next figure in the series of figures to be printed. The said figure is assumed to be the FIG. 8, and in the same way as described above in connection with the FIG. 3, the cam disc for the FIG. 8 provides the following movements in eight successive steps: right, down, left, right, down, left, up, up. Since now both the breaker 19 for the switch-on-cam-disc 18 has switched off and the figure-change-disc 20 has rotated a complete turn, the whole activity of the pilot apparatus is disconnected and it takes its non-active position as illustrated in FIG. 3.

As evident, the operation is started by pressing the short circuit breaker 56 a very short while, and then the apparatus automatically completes a reproduction of one or several characters for which the program mill unit is set.

As previously mentioned also other lines than horizontal and vertical lines can be printed, for instance diagonal lines, whereby both the horizontal drive motor 6 and the vertical drive motor 7 are actuated at the same time or bow-formed lines, whereby the two motors 6 and 7 are actuated at the same time but so as to rotate at varying speeds and different speeds in relation to each other.

In some cases it can be wanted to increase the number of operative steps and in such case one of the cam discs 23 and 29 or both can be formed with a larger amount of grooves 49 and 50 respectively so that the horizontal and vertical distances are split up in several steps than the above described ones.

Figure 6:
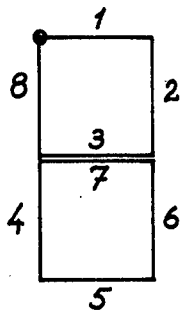

Generally all figures from 0 to 9 can be printed by having the printing tool perform the same movement as when printing the figure 8 and by having the pilot unit actuate the printing tool according to the special figure to be printed. In a simple embodiment of the invention the horizontal drive motor 6 and the vertical drive motor are both connected to a bistable rocker switch so that the two motors are actuated alternatively. By starting the operation with the horizontal guide plate 24 in its left hand position and the vertical guide plate 29 in its upper position, the printer will execute the movement shown in FIG. 6, viz. right, down, left, down, right, up, left, up.

In a preferred embodiment of the invention which is shown in FIG. 8, the horizontal drive motor 6 and the vertical drive motor 7 are interconnected over the bistable rocker switch 65 and the two motors are actuated to perform the eight-step-movements mentioned above. The two motors in turn actuate the guide means 23–27 and 29–33 for the link system 37.

Since all figures are printed following the same movement of the printing tool, the program mill can easily be formed as an electronic unit actuating the printing tool according to the programmed steps for each particular figure, for instance for FIG. 3 by actuation during steps 1, 2, 3 (or 7), 5 and 6 whereas the printing tool is kept nonactuated during step 4, 7 (or 3), 8. In the embodiment shown in FIG. 8, the pilot apparatus is formed for printing three like or different figures at the same time, and for this purpose the apparatus is formed with three different electronic program mills A, B and C which are all connected to the guide unit to obtain a pulse each time the rocker switch 65 changes position, so that the program mill can actuate and disconnect respectively the printing tool according to the particular programmed figure which is set on the program mill. Each program mill is connected to a pneumatic valve 66 which upon actuation supplies pressurized air to three pneumatic tools 67 mounted at the end of the link system 37 at a common bar 68. By setting the program mills A, B and C, the three pneumatic tools can be brought to print the same or different figures at the same time on one or more objects mounted under the printing tools. The program mills A, B and C are identical, and if wanted any number of such program mills can be incorporated in the pilot apparatus to operate separately or in common.

Figure 2:
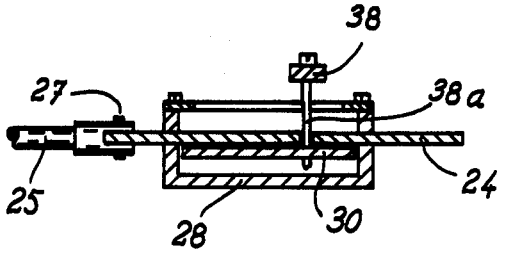
FIG. 2 shows a cross-section along line II—II of FIG. 1, which especially shows the co-ordination means for movements of two directions which are perpendicular to each other.
Figure 7:
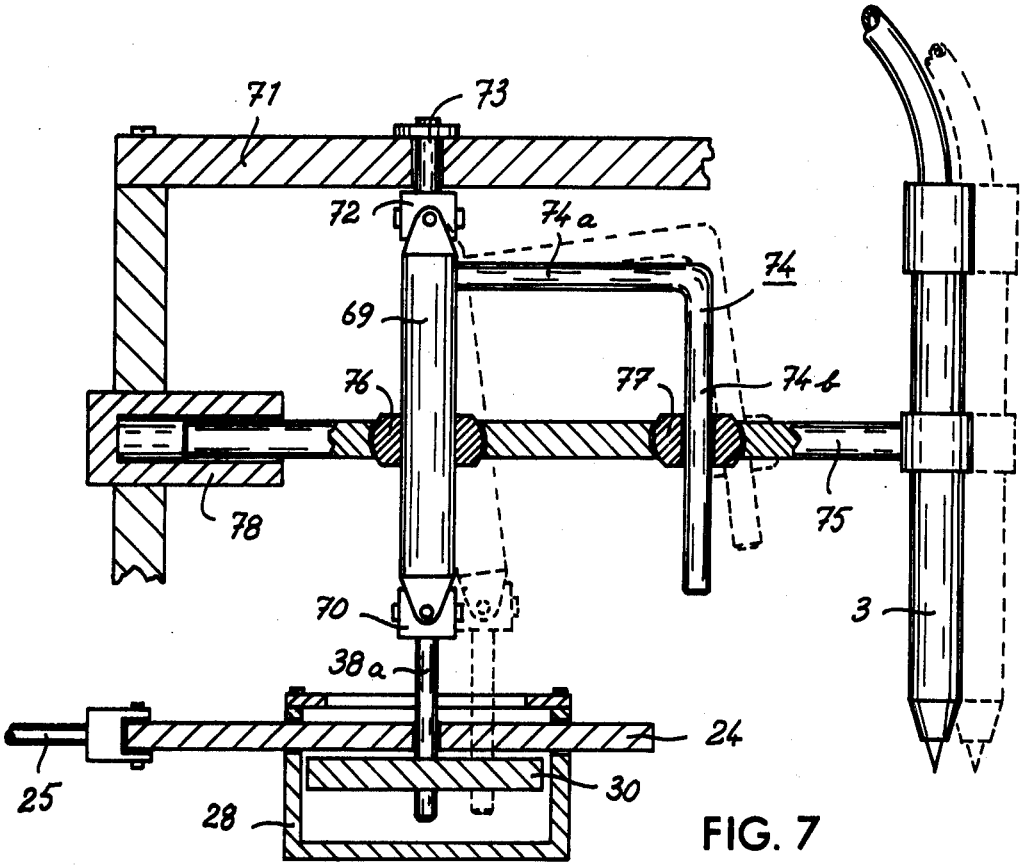
FIG. 7 shows a modified embodiment of the co-ordination means of FIG. 2.

In FIG. 7 is shown an alternative embodiment of the guide unit as described above in connection to FIG. 2. A horizontal guide plate 24 and a vertical guide plate 30 are guided in a guide housing 28 actuated by the two drive motors 6 and 7 respectively. The guide follower 38*a* engages the square hole which is formed at the point where the slots of the guide plates 24 and 30 cross each other as in the previously described embodiment.

The link system includes a follower bar 69 which at the lower end is connected to the follower pin 38*a* by a cardan joint 70 and the upper end of the follower bar 69 is rotatably mounted in a stationary support 71 by a cardan joint 72 and a pivot pin 73 which is axially but rotatably secured in the said support 71. Adjacent the upper end of the follower bar 69 an angle pin 74 is mounted which with one branch 74*a* extends perpendicularly to the follower bar 69 and with the second branch 74*b* extends parallelly to the follower bar 69. A printer arm 75 is mounted on the follower bar 69 and the angle pin 74 by ball joints 76 and 77, and one end of the printer arm extends out of the apparatus and carries the printer tool 3. The opposite end of the printer arm 75 extends beyond the follower bar 69 and is supported in an axial bearing 78. The said bearing 78 and the ball joint 76 on the follower bar 69 are preferably adjustable in the vertical direction whereas the second ball joint 77 is freely slideable along the angle pin branch 74*b*. By moving the printer arm 75 closer to the guide unit 24–30, the printer 3 will print a successively larger character and, by moving the printer arm 75 in the opposite direction, the printer 3 will print a successively smaller character. Thanks to the cardan joints 70 and 72, the follower bar 69 can be moved in any direction following the different movements of the guide plates 24 and 30 and (with dotted lines) is shown the situation when the horizontal guide bar 24 is moved some distance to the right from the position shown with full lines.

It is to be understood that the above specification and the embodiments of the invention shown in the drawings are only of examplifying character and that all kinds of modifications may be presented within the scope of the appended claims.

What we claim is:

1. Automatic pilot apparatus for a printer comprising, in combination:

a program mill including means for setting a character to be printed;

a guide unit connected to said program mill printing means;

means for moving said guide unit in either direction along a first guide path;

means for moving said guide unit in either direction along a second guide path, said second guide path being perpendicular to said first guide path;

said program mill including means for actuating, individually or concurrently, said means for moving said guide unit along said first guide path and said means for moving said guide unit along said second guide path, said actuating means comprising a number of cam discs mounted on a common shaft, each cam disc being programmed for a particular character to be printed, a portion of each cam disc effecting actuation of said means for moving said guide unit along said first guide path and a further portion of each cam disc effecting actuation of said means for moving said guide unit along said second guide path;

link means interconnecting said guide unit and said printing means for transmitting movements of said guide unit to said printing means whereby said printing means reproduces said character; and a further cam disc carried by said common shaft cooperating with a breaker for providing a change of character to be printed and for initiating the printing of a further character in a series of characters to be printed.

2. Automatic pilot apparatus for a printer comprising, in combination:

a program mill including means for setting a character to be printed;

a guide unit connected to said program mill printing means;

means comprising a first motor for moving said guide unit in either direction along a first guide path;

means comprising a second motor for moving said guide unit in either direction along a second guide path, said second guide path being perpendicular to said first guide path;

said program mill including means for actuating, individually or concurrently, said means for moving said guide unit along said first guide path and said means for moving said guide unit along said second guide path; and link means interconnecting said guide unit and said printing means for transmitting movements of said guide unit to said printing means whereby said printing means reproduces said character.

3. Automatic pilot apparatus for a printer comprising, in combination:

a program mill including means for setting a character to be printed;

a guide unit connected to said program mill printing means;

means for moving said guide unit in either direction along a first guide path;

means for moving said guide unit in either direction along a second guide path, said second guide path being perpendicular to said first guide path;

said program mill including means for actuating, individually or concurrently, said means for moving said guide unit along said first guide path and said means for moving said guide unit along said second guide path, said actuating means comprising a number of cam discs mounted on a common shaft, each cam disc being programmed for a particular character to be printed, a portion of each cam disc effecting actuation of said means for moving said guide unit along said first guide path and a further portion of each cam disc effecting actuation of said means for moving said guide unit along said second guide path;

link means interconnecting said guide unit and said printing means for transmitting movements of said guide unit to said printing means whereby said printing means reproduces said character; and each cam disc cooperating with a triple pole breaker for contacting said portion and said further portion of a respective cam disc, said portion comprising a groove in said cam disc and said second portion comprising a remaining portion of said cam disc.

4. Automatic pilot apparatus for a printer comprising:

a program mill;

a guide unit connected to said program mill;

printing means moveable by said guide unit;

a first motor for moving said guide unit in either direction along a first guide path;

a second motor for moving said guide unit in either direction along a second guide path perpendicular to said first guide path;

said guide unit comprising two guide plates moveably mounted in a fixed guide such that the plates are moveable in said first and second guide paths perpendicular to one another, each guide plate including a slot, said guide plates being positioned such that said slots overlap and provide, at the point where the slots cross one another, a guide point for transferring a printing movement from said guide plates to said printing means;

a first rotatable cam disc driven by said first motor for effecting reciprocating movement of a first of said two guide plates in said first guide path;

a second rotatable cam disc driven by said second motor for effecting reciprocating movement of the second of said two guide plates in said second guide path;

each of said first and second rotatable cam discs and its respective drive motor being connected to said program mill such that the guide plates are moved individually or concurrently in dependence upon said first and second rotatable cam discs in a sequence which is determined by the program mill such that said guide point is moved in a path corresponding to the sign which is intended to be printed.

5. Pilot apparatus according to claim 4 further including first and second switches actuated, respectively, by said first and second rotatable cam means, for actuating said program mill whereby at least one of said first and second motors is actuated to move its respective guide plate to execute a writing movement.

6. Pilot apparatus according to claim 5 wherein movement of said first guide plate in said first guide path effects horizontal movement of said printing means and movement of said second guide plate in said second guide path effects vertical movement of said printing means, wherein said first rotatable cam disc comprises at least one pair of diametrically opposed positioning means for actuating its respective switch to effect movement of said horizontal guide plate, and wherein said second rotatable cam disc comprises four positioning means each separated from one another by 90° for actuating its respective switch to effect movement of said vertical guide plate.

7. Pilot apparatus according to claim 6 wherein said positioning means of the first and second rotatable cam discs are grooves provided in the periphery of the cam discs, and in that said first and second switches contact the periphery of the cam discs and for each contact with the said grooves provide an indication to the program mill of a new reproduction function whereby the program mill provides a changed actuation of at least one of said first and second motors.

8. Pilot apparatus according to claim 4 wherein each of said first and second rotatable cam discs is connected to a crank arm which is directly connected to its respective guide plate so that the cam discs at a full turn provide a complete stroke in each direction of movement for the guide plates.

9. Pilot apparatus according to claim 4 further comprising link means connecting said guide point and said printing means, said link means comprising a guide link including a pin extending through said slots at said guide point and a parallelogram linkage having one corner thereof rotatably mounted at a fixed position in said apparatus, said printing means comprising a printing arm connected to said parallelogram linkage.

10. Pilot apparatus according to claim 9 wherein said printer arm is rotatably mounted in a freely moveable arm of said parallelogram linkage and wherein said printing arm extends through a ball joint which is rotatably mounted at a fixed position in the apparatus.

11. Pilot apparatus according to claim 10 wherein the connection point between the printer arm and the freely moveable arm of the parallelogram linkage is displaceable along the moveable arm to provide a change of the movement ratio with which the printing means reproduces the movements at the guide point of the guide plates.

12. Pilot apparatus according to claim 4 wherein said first and second motors are interconnected through a bistaple rocker switch so that the motors are actuated alternatingly, and in that the program mill comprises at least one electronic unit adapted to actuate the printer in accordance with the movements thereof to print any set character.

13. Pilot apparatus according to claim 12 wherein the program mill or mills each actuate a pneumatic valve each supplying pressurized air to a pneumatic printing tool, so that the printing tool is actuated during those step movements which correspond to the set character to be printed whereas the printing tool is disconnected from supply of pressurized air during the remaining movements where no printing is to be made.

14. Pilot apparatus according to claim 13 wherein several printing tools are mounted on a common bar at the end of the printer arm, and wherein each program mill is separately adjustable to provide printing at the same time of several like or different characters.

15. Pilot apparatus according to claim 4 comprising said link means interconnecting said printing means and said guide unit, said link means comprising a vertically mounted follower bar having at one end a pin extending through said slots at said guide point, said follower bar being rotatably mounted at its other end in fixed position in said apparatus, and wherein said printing means comprises a printing arm mounted on said follower bar.

16. Pilot apparatus according to claim 15 wherein said follower bar is formed with a cardan joint at both of its ends and, at its end adjacent the follower bar, carries an angle pin, the outer end of which extends parallel to said follower bar and wherein the printing arm is mounted both on the follower bar and the angle pin by ball joints.

* * * * *